US005287722A

United States Patent [19]

Eck

[11] Patent Number: 5,287,722

[45] Date of Patent: Feb. 22, 1994

[54] PULL TOWER FOR CORRECTING VEHICLE DAMAGE

[75] Inventor: Leonard F. Eck, McPherson, Kans.

[73] Assignee: Hein-Werner Corporation, Waukesha, Wis.

[21] Appl. No.: 800,641

[22] Filed: Nov. 27, 1991

[51] Int. Cl.[5] ..... B21D 1/12

[52] U.S. Cl. ..... 72/447; 72/705

[58] Field of Search ..... 72/447, 457, 705

[56] References Cited

U.S. PATENT DOCUMENTS

| | | | |
|---|---|---|---|
| 3,131,748 | 5/1964 | Junkins | 72/705 |
| 3,689,030 | 9/1972 | Backus | 72/705 |
| 4,386,517 | 6/1983 | Harmon | 72/705 |
| 4,501,136 | 2/1985 | Celette | 72/705 |

*Primary Examiner*—Lowell A. Larson
*Attorney, Agent, or Firm*—Wm. Bruce Day

[57] ABSTRACT

A pull tower for pulling upon a chain and correcting damaged portions of a vehicle includes a combination chain height adjustment and pulley mechanism which is positioned on the tower and with a collar having opposite side plates facing opposite side surfaces of the tower. A front end of the mechanism includes a pulley over which a chain is trained and a front crossbar extending between the side plates and adjacent the tower front surface. The mechanism has a rear end including a rear crossbar spaced from the front crossbar to loosely straddle the tower and a U-shaped spring which extends between the rear crossbar and lugs which extend from the tower rear surface to urge the rear crossbar away from the tower. The mechanism provides an angled, wedging fit of the chain height adjustment and a pulley mechanism on the tower at selected higher locations. Preferably, the tower is mounted to a carriage movably positionable about a work rack, although it can be floor mounted if desired.

7 Claims, 2 Drawing Sheets

Fig. 1
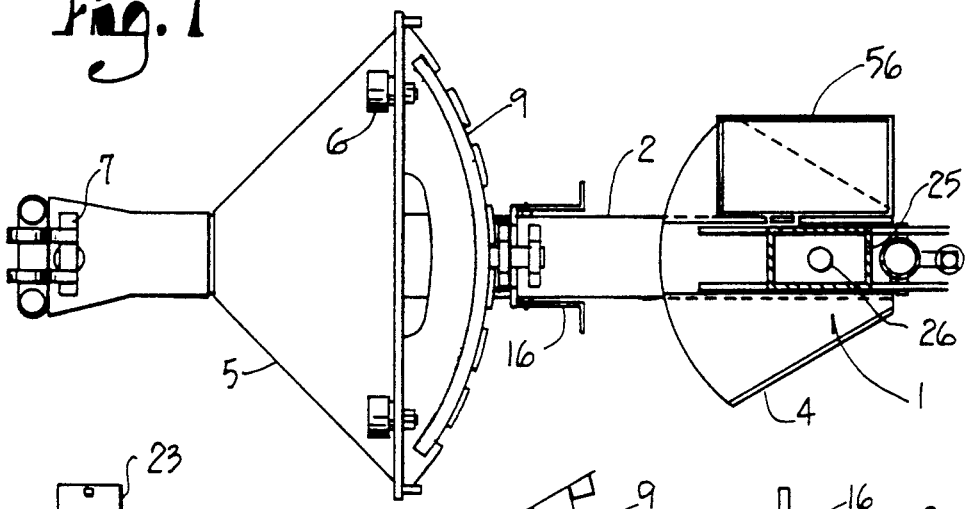
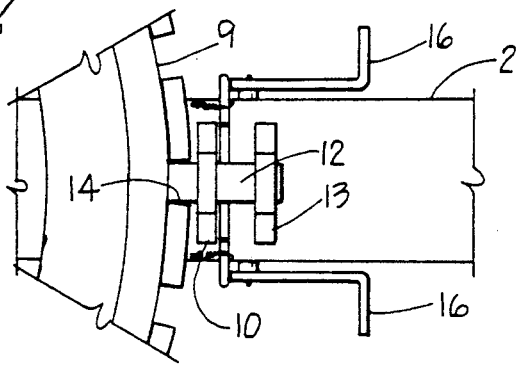
Fig. 2
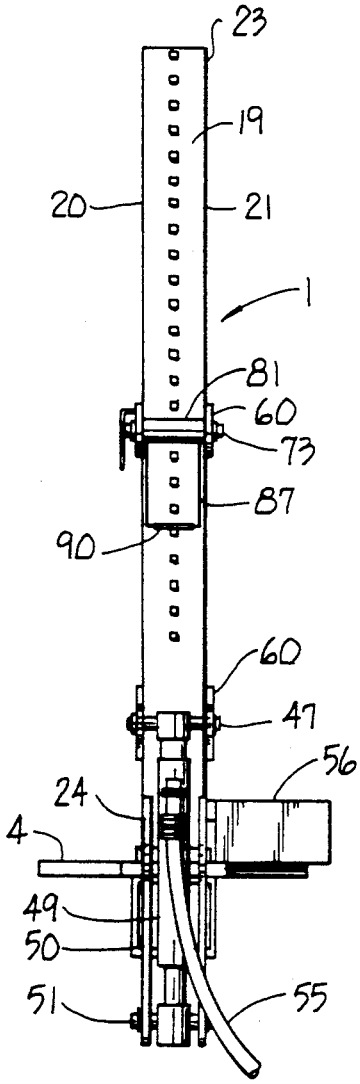
Fig. 3

Fig. 5
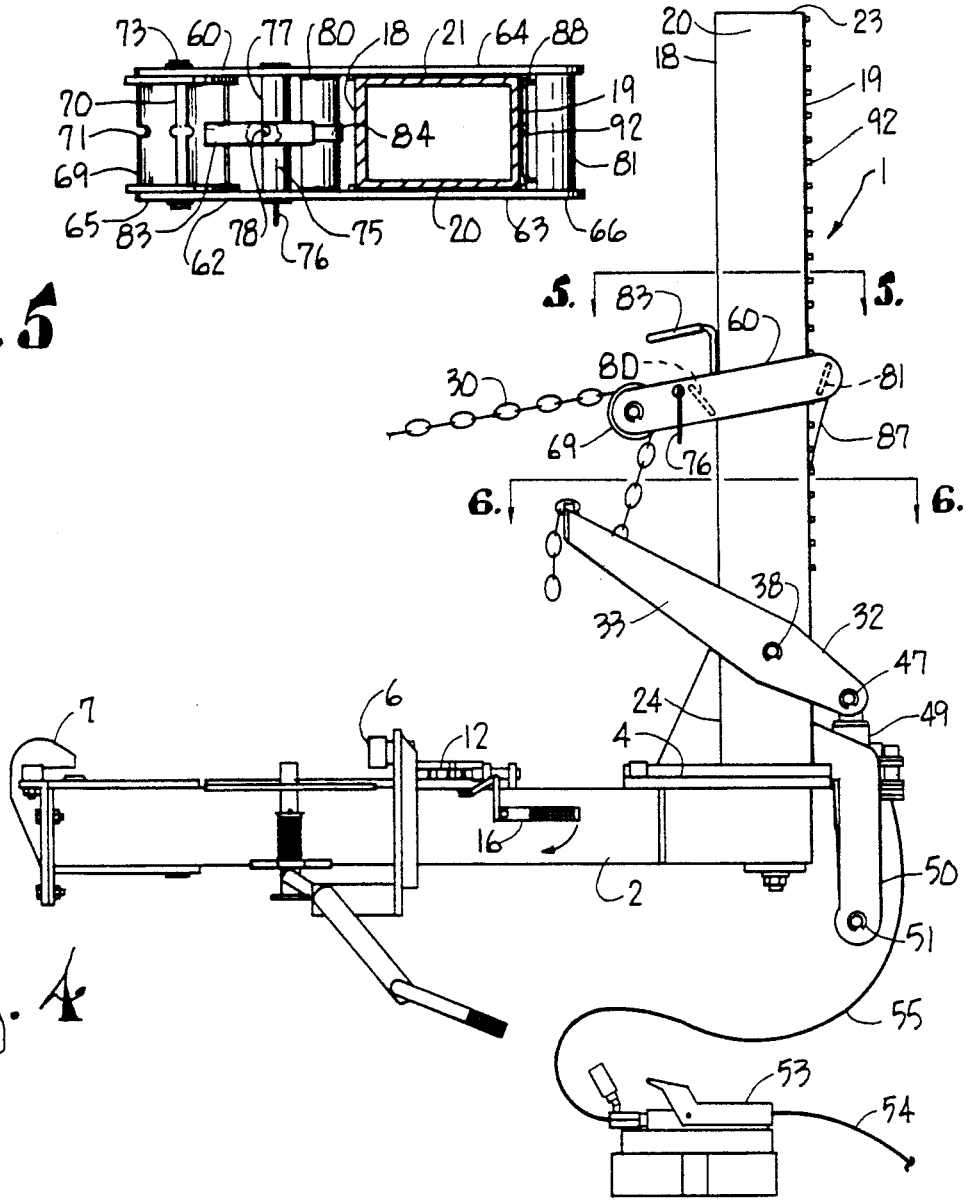
Fig. 4
Fig. 6
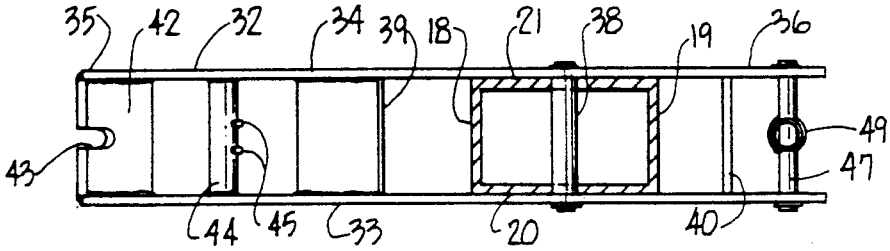

PULL TOWER FOR CORRECTING VEHICLE DAMAGE

FIELD OF THE INVENTION

This invention relates to vehicle straightening and alignment structures and in particular to a pull tower for use in alignment and straightening systems.

BACKGROUND OF THE INVENTION

Pull towers for pulling upon a chain connected to damaged portions of a vehicle have long been known in the automotive frame and body straightening industry and are represented by such prior patents as my U.S. Pat. No. 3,338,083, directed to a particular ram structure used to pull upon the chain. Such pull towers may be floor mounted, as shown in my '083 patent or may be mounted on and part of a vehicle work rack structure, such as shown in my U.S. Pat. No. 4,313,335. In that patent, a pull tower is mounted on a carriage which slides around the periphery of a vehicle work rack. In either case, floor mounted or rack mounted, the pull tower must be effective and easy to use and be able to be sturdily positioned on a supporting surf ace. Additionally, because the damaged portion of the vehicle may be at different heights and different situations, the height of a pulley attached the pull tower for changing the direction of travel of the chain must be easily adjustable. Particularly with tight profit margins, the less set-up time for making the pull, the better for the shop. At the same time the connection of the chain direction changing pulley to the tower must be sufficiently sturdy so that it does not inadvertently slip or become loose when the chain is placed under the significant tensions used in making a pull on a vehicle.

OBJECTS OF THE INVENTION

Accordingly, it is a primary object of the present invention to provide a pull tower for correcting vehicle damage.

The objects of the present invention are: to provide pull tower having an adjustable height pulley mechanism; to provide such a pulley mechanism which is easily and readily adjustable in height; to provide such a pulley mechanism which when placed in a selected position stays in that position and is not reasonably subject to slippage upon exerting a pull; and to provide such a pull tower pulley adjustment mechanism which is efficient and sturdy in use, adaptable for a variety of uses, and well suited for its intended purpose.

Other objects and advantages of this invention will become apparent from the following description, taken in connection with the accompanying drawings which are set forth by way of illustration and example, certain embodiments of this invention.

DESCRIPTION OF THE DRAWINGS

FIG. 1 is a fragmentary view of a pull tower embodying the present invention and mounted on a vehicle work rack pull tower carriage.

FIG. 2 is an enlarged fragmentary view of a portion of the pull tower carriage.

FIG. 3 is a rear elevational view of a pull tower according to the present invention.

FIG. 4 is a side elevational view of the pull tower.

FIG. 5 is a sectional view taken along lines 5—5, FIG. 4.

FIG. 6 is a sectional view taken along lines 6—6, FIG. 4.

DESCRIPTION OF THE PREFERRED AND ALTERNATE EMBODIMENTS

As required, a detailed embodiment of the present invention is disclosed herein, however, it must be understood that the disclosed embodiment is merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Referring in more detail to the drawings:

The reference numeral 1, FIG. 1, generally indicates a pull tower embodying the present invention and used for making a pull upon damaged, misshapened or misaligned vehicle frame embodied parts. The pull tower 1 is mounted on a pull tower carriage 2 which has a swivelable base 4 permitting the pull tower 1 to swivel with respect to the carriage 2 when making a pull. The carriage 2 has a portion 5 which fits under a section of a vehicle frame and body rack, such as the rack disclosed in my U.S. Pat. No. 4,313,335 and with rollers 6 and engaging fingers 7 that connect the base 4 to the underside of the carriage 2, so that it rolls therearound.

As shown in FIG. 1, the pull tower 1 is both swivelable with respect to the carriage 2 and swingable to move from side to side of a vehicle work rack by means of the arcuate mount 9. The position of the tower 1 with respect to the arcuate mount 9 is maintained by a latch mechanism 10. FIG. 2 shows of a manually moveable locking pawl 12 with a T-handle 13 for ease of retraction and extension into lock slots 14 along the arcuate mount 9. The handle 16 assists in moving the carriage 2 relative to the arcuate mount 9.

As shown in FIG. 3, the tower 1 is a vertically elongate square column with front and rear surfaces 18 and 19 and opposite side surfaces 20 and 21 and with a top 23 and a bottom 24. The bottom 24 is connected to the base 4 via an interior plate 25, FIG. 1, and a mounting pivot 26.

To make a chain pull from the pull tower 1 to a vehicle, a chain 30, FIG. 4, is extended from the pull tower 1 and is attached via a leverage mechanism 32. The leverage mechanism 32 consists of spaced elongate plates 33 and 34 with front and rear ends 35 and 36. The leverage mechanism 32 is swingably connected to the tower 1 toward the tower bottom end 24 by a pivot pin 38. Front and rear crossbars 39 and 40 provide rigidity. A front end latch bar 42 includes a chain receiving slot 43 into which a chain link is hooked as shown in FIG. 4 and then passed under an adjacent crossbar 44 having chain guide pins 45 for routing the chain 30 back upwardly. The rear end 36 of the leverage mechanism 32 includes a pivot pin 47 to which the upper end of a ram 49 is attached. The ram is supported at its lower end by a yoke arrangement 50 having a pivot pin 51 at its bottom. The ram 49 can be powered by various fluid power media including air, hydraulic fluid or as shown in the illustrated example, FIG. 4, an air/hydraulic system including an air driven pump 53 with an air inlet line 54 and a hydraulic outflow line 55 routed to the ram 49. To provide handy placement for the pump 53, a mounting tray 56 is situated on the base 4.

A chain height adjustment and pulley mechanism 60, FIG. 5, includes a collar 62 having opposite side plates 63 and 64 facing the tower opposite sides 20 and 21 and with a front end 65 and a rear end 66. The elongate side plates 63 and 64 straddle the tower 1 and extend forwardly a significant distance, FIG. 4. The front end 65 includes a pulley 69 consisting of multiple blades 70 each with aligned slots 71 for receiving the lengths of the chain 30. The pulley 69 is rotatably mounted by a spindle 73 as shown in FIG. 4. The chain 30 is trained about the pulley 69 with the chain links laid in the slots 71 so that the chain may be secured relative to the mechanism 60 after full travel has been reached with the leverage mechanism 32. If the mechanism 32 requires another full travel to effect the pull, a locking dog mechanism 75 is provided which includes a handle 76 which upon being rotated, causes an interior spindle 77 to rotate, engaging the chain within a slot 78 and locking the chain 30 relative to the pulley 69.

To lock the mechanism 60 at a selected height on the tower 1, front and rear engagement plates 80 and 81 are provided. Each of the engagement plates 80 and 81 are angled downwardly as shown in connection with FIG. 4 to provide an interfacing edge which engages the respective surfaces 18 and 19. The front and rear engagement plates 80 and 81 are sufficiently spaced so as to fit loosely about the tower 1 and provide an angled, wedging fit as shown in FIG. 4. To provide an easy means for lifting the mechanism 60 and moving it up and down on the tower 1, a lift handle 83 is provided which has a lower end 84 wrapping about the inner edge of the front engagement plate 80.

A biasing means is provided to assist in maintaining the mechanism 60 in an angled wedging relationship. Preferably and in the best mode of the invention presently known, the biasing means is not used, but certain applications may encourage its use. In the illustrated example, the biasing means includes a U-shaped spring bail 87 including L-shaped upper ends 88 extended into the rear engagement plate 81 and with a lower bight portion 90 covered with a rubber medium for improved gripping ability. Alternatively, the bight portion 90 can be dipped in liquid plastic and then dried. The bail 87 with its bight portion 90 springably bears against a selected one of a series of lugs 92 which extend outwardly from the tower rear surface 19. The lugs 92 provide additional friction bearing and stopping surfaces to insure that the mechanism rear end 66 does not slide downwardly, but remains elevated above the mechanism front end 65 so that the mechanism 60 remains in the wedged, angled relationship shown in FIG. 4. To move the mechanism 60 up and down, the handle 83 is merely grasped and pulled upwardly. This raises the front end 65 relative to the rear end 66 and enables the operator to move the mechanism 60 quickly up and down to a selected location. When reaching the selected location, the operator merely lets go of the handle 83, permitting the front end 65 to drop. Without lugs 92 being on the rear surface 19, the rear end 66 is retarded in movement to permit the front end 65 to drop further and create the wedging, locked effect. When the lugs 92 are employed, the spring bail 87 acts even quicker and with even more positive engaging effect to stop downward movement of the rear end 66, causing the front end 65 to drop faster and causing both plates 80 and 81 to wedge against and lock the mechanism relative to the tower 1.

It will also be appreciated that although the pull tower has been illustrated and described with respect to use on a rack carriage 2, it can be easily employed through the use of a simple stand base so that it could be floor mounted as shown in my earlier U.S. Pat. No. 3,338,083. In such a mounting relationship there would be chain holding rings secured to the pull tower so that it could be chained down to floor anchors to restrain the pull tower 1 from movement. In either mounting relationship, the mechanism 60 provides ease and quickness of adjusting the proper height of the pull chain relative to the pull tower 1.

It is to be understood that while several forms of this invention have been illustrated and described, it is not to be limited to the specific forms or arrangement of parts herein described and shown, except insofar as such limitations are included in the following claims.

What is claimed and desired to be secured by Letters Patent is:

1. A pull tower for pulling upon a chain and correcting damaged portions of a vehicle, said pull tower comprising:

a) an upright tower of rectangular beam configuration having opposite side surfaces, a rear surface, and a front surface for facing a vehicle to be pulled upon;

b) a base at a bottom end of said tower for mounting upon a support surface;

c) means for pulling upon a chain extended from said tower;

d) a chain height adjustment and pulley carrier mounted on said tower and including a collar fitted about said rectangular beam and having:

i) opposite side plates facing said tower side surface, ii) front arm portions extending forwardly from said side plates and having a pulley therebetween over which said chain is trained, iii) said arm portions and said pulley extending sufficiently forwardly to exert a downward rotational force on said carrier due to the weight thereof and which force increases as said chain is tensioned, iv) front and rear crossbars extending between said side plates and having edges for biting contact with the front and rear surfaces of said tower beam, v) said front and rear crossbars being spaced to loosely straddle said tower beam so that said carrier slides on said beam when held perpendicular thereto and rotates downwardly into wedging relationship when released to maintain said carrier at a selected height on said tower beam, and vi) spring biasing means extending between said rear crossbar and said beam rear surface to urge said rear crossbar and said carrier away from said beam rear surface to induce said front arm portions to drop downward into said wedging relationship and maintain biting contact between said carrier and said tower beam.

2. The pull tower set forth in claim 1 wherein said tower has a vertical array of lugs extending outwardly from said rear surface for engagement with said spring biasing means.

3. The pull tower set forth in claim 2 wherein said spring biasing means includes a spring arm extending downwardly from said rear crossbar and engaging a selected one of said lugs on said rear surface.

4. The pull tower set forth in claim 3 wherein said spring arm is U-shaped.

5. The pull tower set forth in claim 1 wherein said means for pulling upon a chain includes a lever means straddling said tower and having a rear end to which a ram is attached and a front end connected to said chain.

6. The pull tower set forth in claim 1 wherein said base means includes means for mounting said tower to a vehicle work rack.

7. A pull tower for pulling upon a chain and correcting damaged portions of a vehicle, said pull tower comprising:

a) an upright tower of rectangular beam configuration having opposite side surfaces, a rear surface, and a front surface for facing a vehicle to be pulled upon;

b) said tower rear surface having a series of lugs extending at least partially up said tower;

c) a base at a bottom end of said tower for mounting upon a support surface;

d) means for pulling upon a chain extended from said tower;

e) a chain height adjustment and pulley carrier mounted on said tower and including a collar fitted about said rectangular beam and having:

i) opposite side plates facing said tower side surfaces, ii) front arm portions extending forwardly from said side plates and having a pulley therebetween over which said chain is trained, iii) said arm portions and said pulley extending sufficiently forwardly to exert a downward rotational force on said carrier due to the weight thereof and which force increases as said chain is tensioned, iv) front and rear crossbars extending between said side plates and having edges for biting contact with the front and rear surfaces of said tower beam, said rear crossbar engaging one of said lugs, v) said front and rear crossbars being spaced to loosely straddle said tower beam so that said carrier slides on said beam when held perpendicular thereto and rotates downwardly in wedging relationship when released to maintain said carrier at a selected height on said tower beam, and vi) a spring arm extending downwardly from said carrier and engaging one of said lugs on said tower beam rear surface for biasing said carrier to a rearward position to induce said carrier to tilt into a wedging relationship at a selected height position and for biting contact between said carrier and said tower beam.

* * * * *